United States Patent [19]

Schuette

[11] 4,441,283

[45] Apr. 10, 1984

[54] STEEPLE

[75] Inventor: Heinz G. Schuette, Brevard, N.C.

[73] Assignee: Horst Witt, Berkley, Mich.

[21] Appl. No.: 391,125

[22] Filed: Jun. 23, 1982

[51] Int. Cl.[3] ..... E04B 7/00; E04B 5/52

[52] U.S. Cl. ..... 52/57; 52/200; 52/462

[58] Field of Search ..... 52/40, 57, 200, 222, 52/762, 637, 638, 649, 697, 465–469, 462

[56] References Cited

U.S. PATENT DOCUMENTS

| | | | |
|---|---|---|---|
| 142,082 | 8/1873 | Chapman | 52/649 |
| 1,802,835 | 4/1931 | Roberts | 52/222 |
| 2,151,521 | 3/1939 | Lindsay | 52/762 |
| 2,361,614 | 10/1944 | Dugan et al. | 52/638 |
| 2,364,083 | 12/1944 | Lindsay | 52/280 |
| 2,519,162 | 8/1950 | Tucker | 52/144 |
| 4,069,626 | 1/1978 | Schuette | 52/57 |

*Primary Examiner*—James L. Ridgill, Jr.

*Attorney, Agent, or Firm*—Basile, Weintraub & Hanlon

[57] ABSTRACT

A steeple includes a plurality of inclined, channel-shaped leg members. A plurality of pairs of vertically spaced connecting members extend between and are joined to opposed ones of the leg members to connect the leg members in a rigid frame, with the leg members disposed at the corners of the frame. Outer panel members having a configuration complimentary to the configuration of the frame between adjacent corner leg members are securable to the leg members. Molding members are receivable within the channel-shaped leg members and urge the side edges of the outer panel members around the outer ends of the channel-shaped leg members and into secure engagement with the inner surface of the leg members. A base having a plurality of similar inclined leg members, connecting members, outer panel members and molding members for securing the outer panel members to the leg members is mountable upon the roof of a building and fixedly supports the frame.

19 Claims, 9 Drawing Figures

STEEPLE

BACKGROUND OF THE INVENTION

1. Field of the Invention

This invention relates, in general, to buildings and, more specifically, to steeples for mounting on the roofs of buildings.

2. Description of the Prior Art

Previously, steeples for buildings, churches and the like have been fabricated at the building site. In most cases, substantially all of the construction takes place directly on the roof of the building. This has resulted in high construction and labor costs for such steeples.

Prefabricated steeples have also been utilized in which substantially all of the steeple is manufactured and assembled at a remote manufacturing site and then shipped to the building site and installed on the roof of the building. While this construction method substantially reduces construction time and the attendant labor costs, it presents other problems involving the shipping of the lengthy, bulky, completed steeple and the necessity for hoisting the completed steeple onto the roof of the building. Both of these factors have tended to offset the cost reductions attained by the use of prefabricating construction techniques.

As illustrated by the steeple disclosed in U.S. Pat. No. 4,069,626, it has also been proposed to construct a steeple of light-weight pre-manufactured components which can be assembled at the building site thereby attaining the benefits of prefabricated construction techniques and reduced shipping and assembly costs.

However, the latter disclosed steeple is not without its drawbacks. For one, the outer panels are secured to the inner frame structure by molding members whose flanges slide over complimentary flanges formed on the edges of the outer panels to telescopingly mount the panels on the inner frame structure. The flanges on the panels must be prefabricated which, due to available manufacturing equipment, limits the length of such panels. As a result, several panels must be mounted above each other to construct a high steeple and, which increases the number of components that must be shipped and assembled to form the steeple.

Secondly, the flanges on the molding members and outer panels are subject to damage during shipping which could render these components unusable at the building site, thereby resulting in construction delays and added material costs.

Due to variations in construction of the inner frame structure, the length of the flange of the outer panels that is present at the edges of the frame does not always correspond to the width of the frame thereby resulting in insufficient mounting support of the panels on the frame and unsightly gaps in the outer surface of the steeple.

Finally, such a steeple is attached to the roof by coupling members which are adjusted to the inclination of the roof. This, however, requires that the entire steeple be assembled on the roof before the final attachment to the roof is attempted. At best, this is a difficult and time consuming task due to the weight and height of the steeple.

Thus, it would be desirable to provide a steeple which overcomes the problems encountered with previously devised steeples. It would also be desirable to provide a steeple which is constructed of a plurality of lightweight components which can be easily transported to the building site and quickly and easily assembled in a complete steeple. It would also be desirable to provide a steeple which can be easily adjusted to a substantially perfect vertical orientation on the roof, despite the variations in the frame construction of the steeple and/or the inclination of the roof. Finally, it would be desirable to provide a steeple which requires single length outer panels, despite the height of the steeple.

SUMMARY OF THE INVENTION

There is disclosed a unique steeple adapted to be mounted on the roof of a building. The steeple includes a plurality of inclined channel-shaped leg members which are laterally spaced apart a greater distance at their bottom ends then at the corresponding top ends. The steeple is provided with a plurality of vertically spaced connecting means which include cross members extending between and joined to opposed leg members for connecting the leg members into a rigid frame, with the leg members disposed at outer corners.

A plurality of outer panel members, each having a configuration complimentary to the configuration of the frame between adjacent corner leg members, are provided for enclosing the frame. Molding members, each receivable within one of the open channel-shaped leg members, are provided for engaging and urging the side edges of the outer panel members around the outer ends of the leg members and into secure engagement with the inner surfaces of the leg members.

Means for mounting the lower ends of the leg members to the roof of a building is provided. The mounting means includes a base assembly having a plurality of channel-shaped leg members, cross members extending between opposed base leg members, outer panel members having a shape complimentary to the configuration of the base between the corner base leg members and molding members for urging the side edges of the base panel members around the outer edges of and into engagement with the leg members. Attachment means are provided for securing the frame to the base assembly and for providing adjustment of the frame with respect to the base assembly so as to enable the frame to be positioned in a substantially vertical position on the base assembly.

Finally, an indicia bearing member, such as a post having a cross, emblem or the like mounted thereon, is receivable within and secured to the spaced upper ends of the leg members of the frame to complete the steeple.

The unique steeple of the present invention overcomes many of the problems encountered with the use of previously devised steeples adapted to be mounted on the roof of a building. The present steeple is constructed of light-weight components which can be easily transported and assembled at the building site into a complete steeple, thereby significantly reducing shipping, material and construction costs.

The unique mounting of the outer panels to the frame of the steeple provided by mounting members which are receivable within the channel-shaped leg members of the frame enables steeples of any desired height to be constructed with single length outer panels on each side. This is possible since the edges of the outer panels are not preformed or bent into flanges, as is the case with previously devised steeples, which enables any length outer panels to be manufactured and, more importantly, to be rolled up into a coil for ease of transportation to the building site.

The steeple of the present invention also provides easy adjustment of the upper portion of the steeple into a substantially perfect vertical orientation despite construction variations in the frame or variations in the inclination of the building roof.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
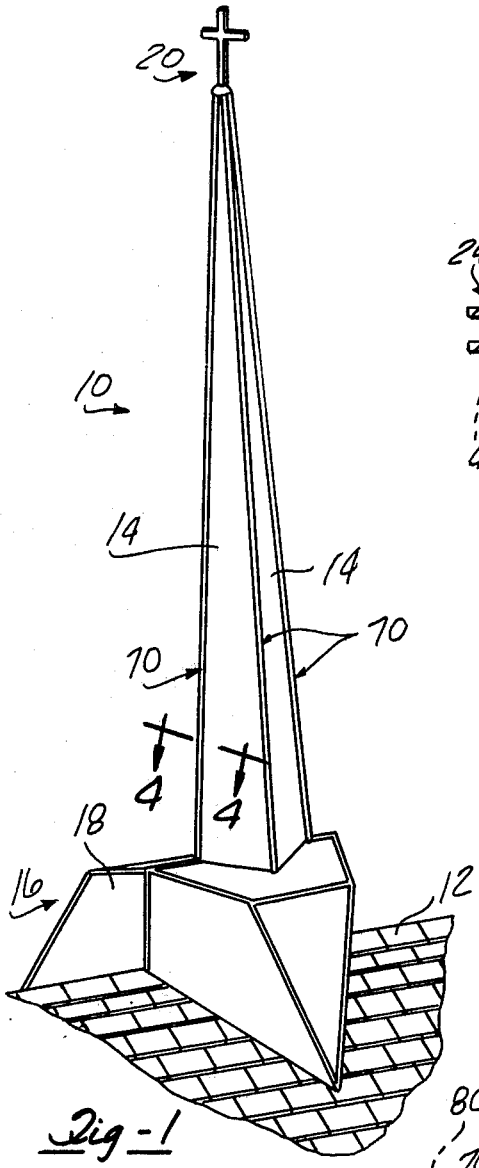
FIG. 1 is a perspective view of a steeple constructed in accordance with the teachings of the present invention mounted on the roof of a building.

Throughout the following description and drawing, an identical reference numbers is used to refer to the same component shown in multiple figures of the drawing.

Referring now to the drawings, and to FIG. 1 in particular, there is illustrated a steeple 10 constructed in accordance with the teachings of the present invention which is adapted to be mounted on the roof 12 of a building, such as a church or the like. In general, the steeple 10 is formed with an inner frame structure to which are secured a plurality of outer panel members 14. A base mounting structure 16 is provided for mounting the inner frame structure and outer panels 14 to the roof 12 of the building. The base frame 16 also includes outer panel members 18. An indicia bearing member 20, such as a post having a cross, emblem, etc., mounted thereon, is receivable within and attached to the upper ends of the inner frame.

Figure 2:
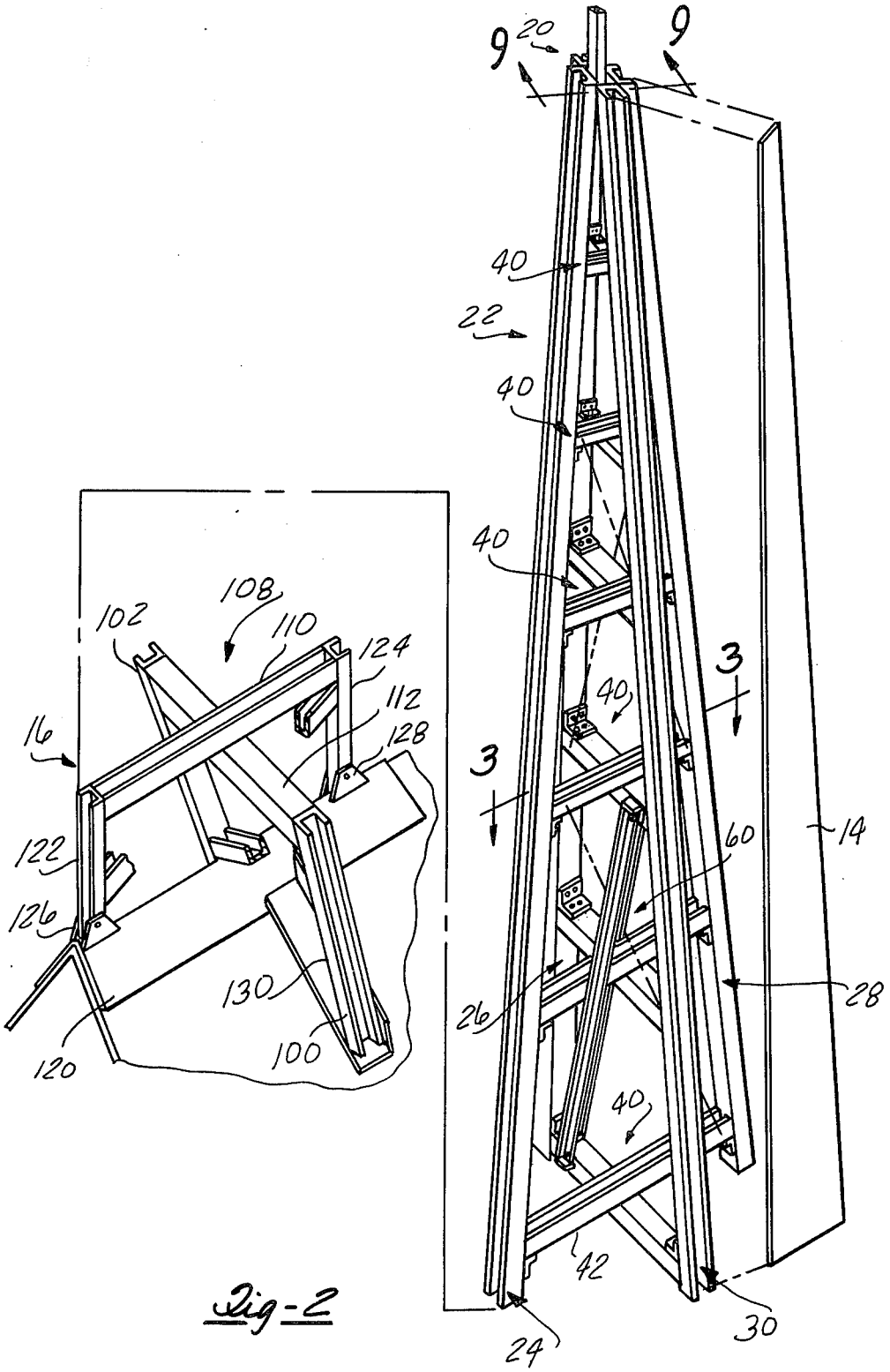
FIG. 2 is a partially exploded perspective view of the steeple illustrated in FIG. 1.

As shown in FIG. 2, the inner frame 22 includes a plurality of inclined leg members, such as leg members 24, 26, 28 and 30, the lower ends of which are laterally spaced apart a greater distance then the corresponding upper ends. Each of the leg members 24, 26, 28 and 30 has a substantially U-shaped, channular configuration with opposed side legs 32 and 34 and an interconnecting middle portion 36 as shown in FIG. 2. Each of the leg members 24, 26, 28 and 30 is oriented with the open ends of the channel extending outward from the frame 22.

The leg members 24, 26, 28 and 30 are preferably formed of a lightweight material, such as aluminum. It is possible, however, to construct the leg members of other lightweight materials, such as fiberglass or plastic.

The steeple 10 also includes a plurality of vertically spaced means 40 for connecting the leg members 24, 26, 28 and 30 into a rigid frame with the leg members disposed at outer corners of the frame. Each of the connecting means 40 includes cross members which extend between and are joined to opposed ones of the leg members. In a preferred embodiment, the connecting means 40 includes first and second cross members 42 and 44, respectively. The cross member 42 extends between leg members 24 and 28; while the cross member 44 extends between leg members 26 and 30.

Figure 3:
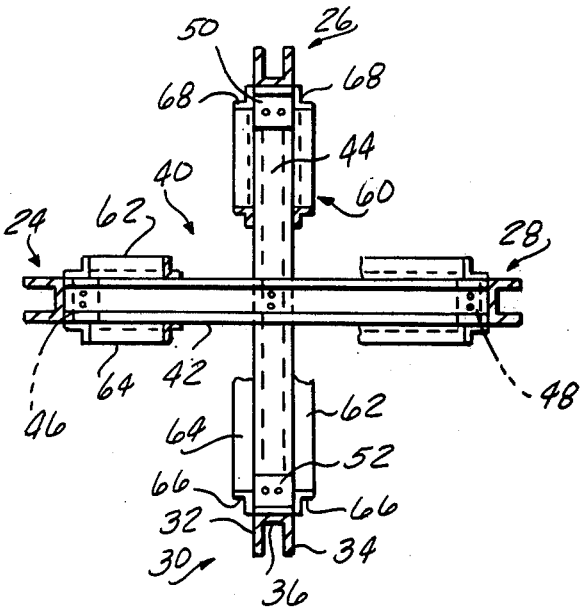
FIG. 3 is a cross sectional view generally taken along line 3—3 in FIG. 2.

As shown in FIG. 3, the cross members 42 and 44 are arranged in an overlapping, substantially perpendicular configuration, with cross member 42 disposed above cross member 44. The cross members 42 and 44 abut at the central portion thereof and are secured together, by suitable fastening means, such as bolts. In a preferred embodiment, each of the cross members 42 and 44 is constructed with a U-shaped channel configuration, with the open channel of upper cross member 42 oriented in an upward facing direction and the open channel portion of lower cross member 44 extending downward.

Angle brackets having perpendicularly oriented first and second legs are joined by suitable fasteners to the ends of the interconnecting middle portion of each of the U-shaped cross members 42 and 44, with one of the legs of the angle brackets extending outward from the associated cross member. Thus, cross member 42 has angle brackets 46 and 48 fastened at opposed ends thereof. Correspondingly, cross member 44 has angle brackets 50 and 52 fastened at opposed ends thereof. The angle brackets 46, 48, 50 and 52 provide a means for connecting the cross members 42 and 44, respectively, to the associated leg members 24, 26, 28 and 30. In the orientation illustrated in FIGS. 2 and 3, the outwardly extending legs of angle brackets 46 and 48 secured to cross member 42 extend downward from the intermediate portion of cross member 42 and are secured by suitable fasteners to the intermediate portions of leg members 24 and 28. As cross member 44 is oriented with the channel portion extending in a downward direction, the outwardly extending legs of angle brackets 50 and 52 extend vertically upward from the cross member 44 and are secured to the intermediate portion of leg members 26 and 30, respectively.

As shown in FIG. 2 and partially in FIG. 3, a plurality of cross braces 60 are secured to alternating ones of the connecting means 40 to provide additional structural strength for the frame 22. Each cross brace 60 includes a pair of angle-shaped elongated members 62 and 64 having small angle brackets, such as angle brackets 66 and 68, connected at opposed ends thereof. The angle brackets 66 and 68 are secured to the sides of the cross members 42 and 44 by suitable fastening means, such as bolts. The cross braces 60 and 62 extend diagonally between alternating ones of the connecting means 40 and are connected to both connecting means 40 at opposite ends of the cross members. Thus, by way of example, the cross braces 60 and 62 are connected to one end of cross member 42 and extend diagonally to the opposite end of cross member 44 in the second vertically spaced connecting means 40.

Additional cross brace assemblies 60 extend diagonally between the ends of the cross members associated with the opposed pair of leg members 26 and 30 to provide structural strength for the frame 22.

As indicated generally above, the steeple 10 is provided with a plurality of outer panel members 14. Each outer panel member 14 has a configuration which is complimentary to the configuration of the frame 22 between adjacent corner leg members 24, 26, 28 and 30. As viewed in FIG. 2, each outer panel member 14 has a generally triangular configuration with a truncated upper end portion.

Each outer panel member 14 is preferably formed from a lightweight material, such as aluminum, and has a planar cross section. The outer panel members 14 function to enclose the inner structure of the frame 22 of the steeple 10.

Figure 4:
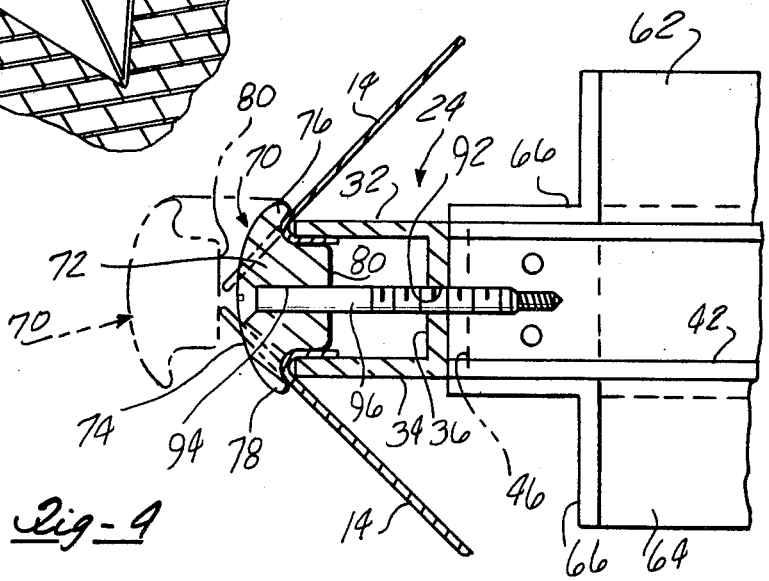
FIG. 4 is a enlarged cross-sectional view, generally taken along line 4—4 in FIG. 1, showing the connecting means.
Figure 5:
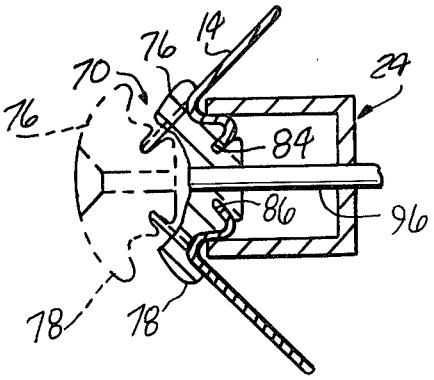
FIG. 5 is a cross sectional view, similar to FIG. 4, but showing another embodiment of the connecting means.
Figure 6:
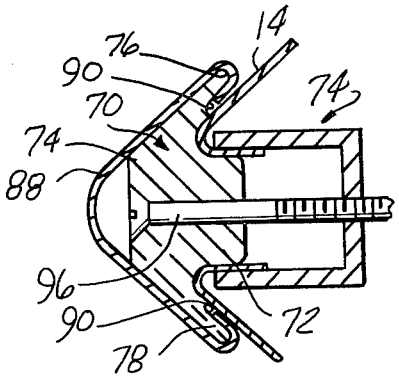
FIG. 6 is a cross sectional view similar to FIG. 4, but showing yet another embodiment of the connecting means.

As shown in FIG. 1, and in greater detail in FIGS. 4, 5 and 6, means, denoted in general by reference number 70, are provided for securely attaching the outer panel members 14 to the frame 22. The attaching means 70 preferably comprises elongated molding members which are receivable in the open channel portions of each leg member 24, 26, 28 and 30. Each molding member 70 may be formed of any suitable material, such as extruded aluminum, as well as other lightweight materials, such as fiberglass or plastic.

The molding members 70 are adapted to engage the side edges of the outer panel members 14 and urge the side edges of the outer panel members 14 around the outer ends of the channular leg members and into secure engagement with the inner surfaces of the channel portion of the leg members.

In one embodiment depicted in FIG. 4, the molding member 70 is formed with a first narrowed down portion 72 which is adapted to be slidably received within the open channel end of a leg member, such as leg member 24. The molding member 70 is further provided with an enlarged second portion 74 integrally formed with the first portion 72 and which includes outwardly extending side flanges 76 and 78 which define shoulders at the inner surfaces thereof.

In attaching the outer panel members 14 to the frame 22, the molding member 70 engages the side edges of two adjacent outer panel members 14 at a first inner end portion 80, as shown in phantom in FIG. 4. As the molding member 70 is urged inward within the leg member 24, the molding member 70 bends the side edges of the outer panel members 14 inward around the outer ends of the channel legs 32 and 34 of the leg member 24 forming an approximately 45° bend in the side edge portions of the panel members 14. The edges of the panel members 14 are thus urged into engagement with the inner surfaces of the legs 32 and 34 of the channel-shaped leg member 24 thereby securely mounting the outer panel members 14 on the frame 22.

When fully seated within the leg member 24, the side flanges 76 and 78 on the molding member 70 are disposed in registry with the bend in the outer panel members 14 to provide additional mounting support for the outer panel members 14.

Another embodiment of the molding member 70 is illustrated in FIG. 5 and is identical to that depicted in FIG. 4 and described above except for the addition of a pair of lengthwise extending slots 84 and 86 in the molding member 70. The slots 84 and 86 slidingly receive the side edges of the outer panel members 14 and bend the side edges of the outer panel members 14 in a 45° angle around the outer ends of the legs 32 and 34 of the leg member 24 as the molding member 70 is urged into the leg member 24. The slots 84 and 86 form a second reversed bend in the side edges of the panel members 14 to provide a more secure mounting of the panel members 14 on the frame 22.

Another embodiment of the molding member 70 is illustrated in FIG. 6. In this embodiment, the molding member 70 is formed with a narrow inner end portion 72 and an enlarged outer portion 74 with outward extending flanges 76 and 78 extending outward therefrom. Side recesses 90 are formed in the exterior ends of the flanges 76 and 78 and receive the bent over ends of a cover member 88 which is disposed in registry with and covers the exterior surface of the molding members 70. The cover member 88 is preferably formed of the same material as the outer panels 14 so as to match the exterior surface of the outer panels 14.

It should also be noted that a cover member similar to cover member 88 may also be applied to either of the other embodiments of the molding member 70 shown in FIGS. 4 and 5.

All embodiments of the molding member 70 illustrated in FIGS. 4, 5 and 6 are adapted to be securely fastened to one of the leg members of the frame 22. Each leg member 24, 26, 28 and 30 is provided with a plurality of vertically spaced apertures 92 which are formed in the middle portion 36 of each leg member. Each molding member 70 is likewise provided with a plurality of vertically spaced apertures 94 which are alignable with the apertures 92 in the leg members 24, 26, 28 and 30. A suitable fastening means 96, such as a self tapping screw, is insertable through the aligned apertures 94 in the molding member 70 and the apertures 92 and the leg members 24, 26, 28 and 30 so as to draw the molding members 70 into the open channel of each leg member 24, 26, 28 and 30 and securely fasten the molding members 70 therein.

As described above, the steeple 10 is provided with means for connecting the frame 22 to the roof 12 of a building. The connecting means, as illustrated in FIG. 1, and in greater detail in FIG. 2, comprises a base frame assembly 16. The base frame assembly 16 includes a plurality of inclined leg members 100 and 102, each having a substantially U-shaped channular configuration. The leg members 100 and 102 are inclined at a greater outwardly extending angle then the corresponding leg members 24, 26, 28 and 30 of the frame 22 and are alignable with certain leg members of the frame 22 so as to form a continuous channel along the length of the aligned leg members in the frame 22 and base frame 16. Connecting means 108 in the form of a pair of cross members 110 and 112 which are connected to leg members 100 and 102 and a pair of vertically extending U-shaped straps 122 and 124, respectively, are provided for interconnecting the leg members 100 and 102, into a rigid frame.

Molding members, not shown, which are identically constructed as molding members 70, described above, are provided for engagement with the open channel of each leg member 100 and 102 and serve to attach outer panel members 18 thereto to completely enclose the inner structure of the base frame 16.

A U-shaped roof peak member 120 is securable to the peak of the roof 12 of the building. The pair of vertically extending straps 122 and 124 are connected at a lower end between a pair of spaced connector members 126 and 128 mounted on the roof peak member 120. The upper ends of the U-shaped straps 122 and 124 are fastened to the sides of cross member 110 by suitable fastening means, such as bolts. Cross braces, identical to cross braces 60 and 62 described above, extend between and are joined to the straps 122 and 124 and the leg members 100 and 102. Elongated angle-shaped members 130 having perpendicular oriented legs are secured to the roof peak member 102 and the roof 12 and form a base for the lower ends of the legs 100 and 102 which are fastened thereto.

Figure 7:
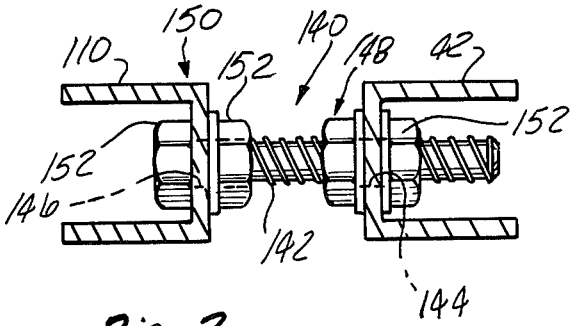
FIG. 7 is a cross sectional view taken through the lowermost cross member of the inner frame and the uppermost cross member of the base frame showing the means for adjusting the position of the inner frame on the base frame.

Means, denoted in general by reference number 140 in FIG. 7, are provided for adjustably positioning the frame 22 on the base frame 16 so as to orient the frame 22 in a substantially perfect vertical orientation on the roof 12 of the building despite dimensional variations in the frame 22 and inclinations of the roof 12. The adjustable positioning means 140 preferably comprises a plurality of elongated threaded shafts 142, only one of which is illustrated, which extend through aligned apertures 144 and 146 in the intermediate portions of the lowermost cross member 110 of the base frame 16. A plurality of adjustable positioning means 140 are provided at each end of the cross member 42, 44, 110 and 112.

Pairs of connector means, such as connector means 148 and 150, each comprising pairs of cooperating nuts 152, are provided for adjusting the vertical spacing between the cross members of the frame 22 and 16. Thus, by adjustably positioning the cooperating pairs of fasteners 148 and 150 along the length of each threaded shaft 142, with varying amounts of spacing provided around the four sides of the steeple 10, the steeple 10 may be oriented in a substantially perfect vertical orientation on the roof 12 of the building despite the presence of any dimensional variations in the steeple 10 or differing inclinations in the roof 12 of the building.

Figure 8:
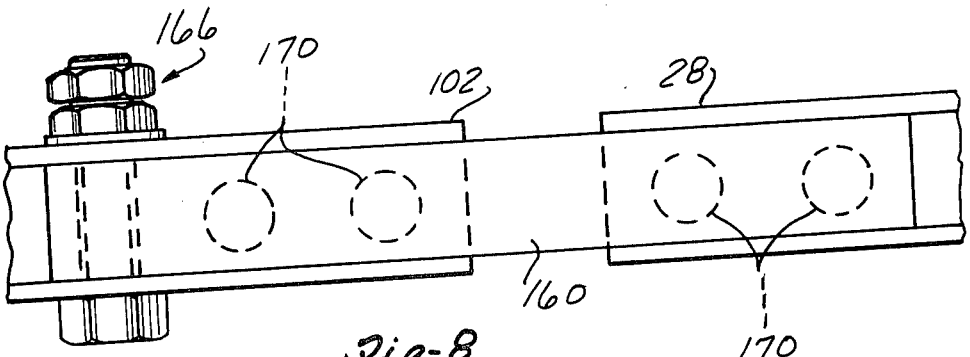
FIG. 8 is a cross sectional view taken along the side of the inner and base frames showing the means for attaching the inner frame of the base frame.

The frame 22 is securely attached to the bottom frane 16 by means of a plurality of attaching members 160, one of which is illustrated in detail in FIG. 8. Each attaching member 160 comprises an elongated strap having a square cross section which is sized to fit within the opposed side legs of the aligned leg members in the frames 22 and 16. The strap 160 is secured to a leg in the bottom frame 16, such as leg 102, by means of a pair of fastening means, such as bolts 166, only one of which is illustrated in FIG. 8. The bolt 166 is inserted through the opposed side walls of the leg 102 and through a bore formed in the strap 160. Additional mounting bores 170 are then drilled along the length of the strap 160 and through the intermediate portions of the leg 102 of the bottom frame 16 and the aligned leg 28 of the frame 22. Fastening means, such as bolts, may then be inserted through the aligned apertures to securely attach and mount the frame 22 on the base frame 16.

Figure 9:
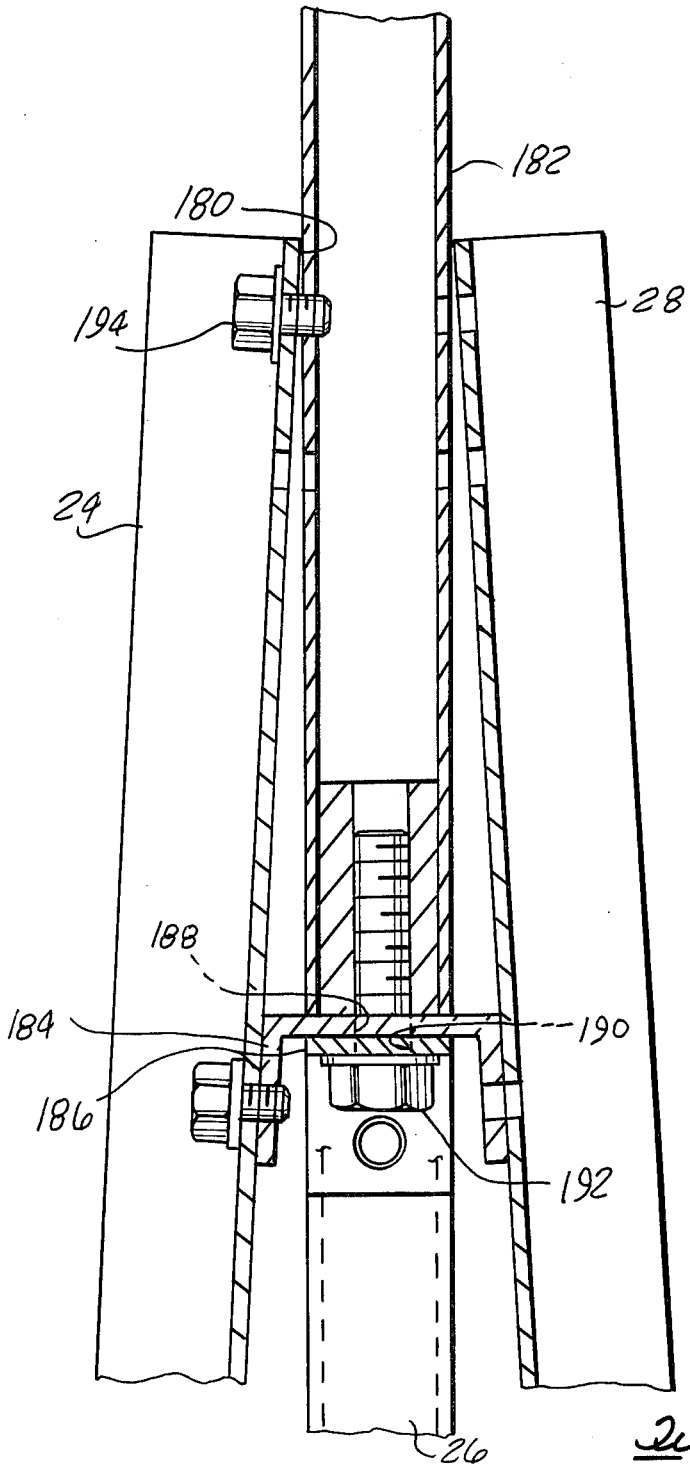
FIG. 9 is a cross sectional view generally taken along line 9—9 in FIG. 2.

As shown in FIGS. 1 and 2, and in greater detail in FIG. 9, the steeple 10 is provided with an indicia bearing member 20 which is inserted within and secured to the upper portions of the legs 24, 26, 28 and 30 which taper inwardly in a vertical direction so as to define an aperture 180 at the upper ends thereof. The aperture 180 is sized to slidingly receive a substantially square cross sectional post member 182 having various indicia, such as a cross, emblem or the like, mounted at an upper end thereof.

A pair of overlapping, open-ended channel members 184 and 186 are secured to opposed legs at a position spaced slightly downward a short distance from the upper ends of the legs 24, 26, 28 and 30 of the frame 22. Channel member 184 thus extends between opposed legs 24 and 28; while channel member 186 extends between legs 26 and 30. Fastening means are provided for attaching the opposed side walls of the channel members 184 and 186 to the middle portions of the legs 24, 26, 28 and 30. Aligned apertures 188 and 190 are formed in the overlapping intermediate portions of the channel members 184 and 186 and threadingly receive a fastening means 192 which extends therethrough into the lower portion of the post 182 for securing the lower portion of the post 182 to the frame 22. Additional fastening means, denote in general by reference number 194, extend through the intermediate portion of the legs 24, 26, 28 and 30 adjacent the upper ends thereof and into the sides of the post member 182 for securing the post member 182 to the frame 22.

In constructing the steeple 10, the various components forming the frame 22 are initially assembled into a completed form including the indicia bearing member 20 and the outer panel member 14. Likewise, the components joining the base frame 16 except for the outer panels 18 are assembled into a completed form and mounted in the desired position on the roof 12 of the building.

Each of the attaching members or straps 160 are loosely to attached legs 24, 26, 28 and 30 of the frame 22 by inserting one fastener or bolt 166 through the aligned bores in the straps 160 and the legs 24, 26, 28 and 30. The frame 22 is then hoisted up on the roof 12 and a fastener or bolt 166 is inserted through and loosely secured in the aligned bores in one of the straps 160 and a leg of the frame 22. The frame 22 is then swung about the bolt 166 to an upright position and a second bolt 166 is loosely interconnected between an opposed strap 160 and leg of the frame 22.

Next, the adjustable positioning means 140 are applied to the frame 22 and 102, as described above, and adjusted to orient the frame 22 in a substantially vertical position. Additional bores 170 are then formed in the straps 160 and legs of the frame 22 and 102 and fasteners secured therein to securely attach the frame 22 on the bottom frame 102. Finally, the outer panel members 18 are attached to the bottom frame 102 to complete the steeple 10.

Thus, there has been disclosed a unique steeple which is adapted to be mounted on the roof of a building, such as a church or the like. The steeple is constructed of a plurality of lightweight components which may be easily transported and assembled at the construction site into a complete steeple. The steeple is provided with a plurality of outer panel members which cover an interior frame structure and may be formed of single panels of any desired length for constructing a steeple of any height. The unique steeple of the present invention may also be adjusted during its attachment to the roof of the building so as to attain a substantially perfect vertical orientation despite constructional variations in the steeple 10 and varying inclinations in the slope of the roof of the building to which the steeple is attached.

What is claimed is:

1. A steeple comprising:

a plurality of inclined leg members, the lower ends of which are laterally spaced apart a greater distance than the corresponding upper ends, each of the leg members having a channel-shaped cross-sectional configuration opening outward from the steeple;

a plurality of vertically spaced means for connecting the leg members into a rigid frame with the leg members disposed at the corners thereof, each connecting means including a plurality of cross members, each extending between and joined to opposed ones of the leg members;

a plurality of planar outer panel members, each having a configuration complimentary to the configuration of the frame between adjacent corner leg members;

molding means for bending the side edges of the outer panel members around the outer ends of the leg members and into secure engagement with the inner surfaces of the leg members;

means for mounting the lower ends of the leg members to the roof of a building; and an indicia bearing member receivable within and secured to the upper ends of the leg members.

2. The steeple of claim 1 further including:

means for mounting the indicia bearing member to the leg members, the indicia bearing member mounting means comprising:

overlapping connector members extending between and secured to opposed ones of the leg members at the upper ends thereof, the overlapping connector members defining a base for the indicia bearing member;

first fastening means extending through the overlapping portions of the connector members and engaging the indicia bearing member; and a plurality of second fastening means extending through the leg members and engaging the indicia bearing member for securing the indicia bearing member to the leg members.

3. The steeple of claim 1 further including a plurality of cross braces extending diagonally between the ends of the first and second cross members in one of the connecting means and opposite ends of the first and second cross members in one of the other vertically-spaced connecting means.

4. The steeple of claim 1 wherein:

the molding means includes a plurality of molding members, each receivable in one of the leg members.

5. The steeple of claim 4 wherein the molding members further include a pair of opposed, lengthwise extending slots adapted to receive the side edges of the outer panel members and form a first inward extending bend in the outer panel members around the outer ends of the channel-shaped leg members and a second outwardly extending reversed bend in the outer panel members adjacent the side edges thereof.

6. The steeple of claim 4 wherein:

the leg members having a plurality of vertically spaced apertures formed intermediately along each leg thereof;

the molding members have a plurality of spaced apertures formed along the length thereof; and further including fastening means, extendable through aligned apertures in the molding members and the leg members, for fastening the molding members to the leg members.

7. The steeple of claim 4 wherein the molding members include:

a first portion receivable within the channel portion of the leg members; and an enlarged second portion integral with the first portion and having side flanges extending outward therefrom defining shoulders for urging the sides of the outer panel members into engagement with the outer ends of the leg members.

8. The steeple of claim 1 wherein the connecting means comprises:

first and second cross members, the first and second cross members being disposed in an overlapping configuration and disposed in registry at a central portion thereof; and means for attaching opposed ends of the first and second cross members to certain of the leg members.

9. The steeple of claim 8 wherein the cross members have a channel-shaped cross sectional configuration and are arranged in inverted orientations with the open ends thereof extending outward.

10. The steeple of claim 8 further including;

means for fastening the overlapping portions of the first and second cross members together.

11. The steeple of claim 1 wherein the means for mounting the lower ends of the leg members on the roof comprises:

a base including:

a plurality of inclined leg members each having a channel-shaped cross-sectional configuration and alignable with a leg of the frame;

means for connecting the base leg members into a rigid base frame with the base leg members disposed at the corners thereof, the connecting means including a pair of cross members extending between and joined to opposed ones of the base leg members;

a plurality of planar outer members, each having a configuration complimentary to the configuration of the base frame between adjacent corner base leg members;

molding means for bending the side edges of the outer panel members around the outer ends of the base leg members and into secure engagement with the inner surfaces of the base leg members;

means for attaching the frame to the base frame; and means for attaching the lower ends of the base leg members to the roof of a building.

12. The steeple of claim 11 wherein the attaching means comprises:

a plurality of elongated straps receivable within the aligned channel portions of the frame and base frame leg members; and means for fastening the straps to the frame and base frame leg members.

13. The steeple of claim 12 further including:

a substantially U-shaped member disposed in registry with and securable to the peak of the roof of a building: and vertically extending straps secured to the U-shaped member at one end and one of the cross members at a second end.

14. The steeple of claim 12 further including:

means for adjusting the vertical orientation of the frame on the base frame.

15. The steeple of claim 14 wherein the adjusting means comprises:

a plurality of threaded shafts extending through aligned apertures in one of the cross mebers of the frame and the base frame; and connector means, adjustably movable on each threaded shaft, for selectively varying the length of each threaded shaft disposed between the cross members of the frame and the base frame so as to vary the vertical orientation of the frame on the base frame.

16. A steeple mountable on the roof of a building comprising:

first, second, third and fourth inclined leg members, the lower ends of which are laterally spaced apart a greater distance then the corresponding upper ends, each of the first, second, third and fourth leg members having a U-shaped channular cross sectional configuration opening outward from the steeple;

a plurality of vertically spaced means for connecting the first, second, third and fourth leg members into a rigid frame with the first, second, third and fourth leg members disposed at the corners thereof, each of the connecting means including first and second cross members, each extending between and joined to opposed ones of the first, second, third and fourth leg members;

first, second, third and fourth planar outer panel members, each having a configuration complimentary to the configuration of the frame between adjacent corner first, second, third and fourth leg members;

first, second, third and fourth molding members, each receivable in the channel portions of one of the first, second, third and fourth leg members, each of the first, second, third and fourth molding members engaging and urging the side edges of the first, second, third and fourth outer panel members around the outer ends of the channel-shaped leg members and into secure engagement with the inner sides of the channel-shaped leg members;

means, extendable through the first, second, third and fourth molding members and the first, second, third and fourth leg members, for fastening the molding members to the leg members;

base means for mounting the frame on the roof of a building, the base means comprising:

fifth, sixth, seventh and eigth inclined leg members, each having a U-shaped channular cross sectional configuration opening outward from the base;

first and second cross members extending between and joined to opposed ones of the fifth, sixth, seventh and eigth base leg members and disposed in an overlapping abutting relationship at a central portion thereof; and a plurality of base outer panel members having a configuration complimentary to the configuration of the base between adjacent corner leg members;

a fifth, sixth, seventh and eighth molding member, each receivable in the channel portions of one of the fifth, sixth, seventh and eighth base leg members and urging the side edges of the base outer panel members around the outer ends of the base by members and into secure engagement with the inner sides of the base leg members;

an indicia bearing member receivable within and securable to the upper ends of the first, second, third and fourth leg members.

17. The steeple of claim 16 further including means for attaching the frame to the base frame, the attaching means comprising:

a plurality of elongated straps receivable within the aligned channel-shaped leg members of the frame and base frame; and means for fastening the straps to the frame and base frame leg members.

18. The steeple of claim 16 further including:

means for adjusting the vertical orientation of the frame on the base frame.

19. The steeple of claim 18 wherein the adjusting means comprises:

a plurality of threaded shafts extending through aligned apertures in one of the cross members of the frame and the base frame; and connector means, adjustably movable on each threaded shaft, for selectively varying the length of each threaded shaft disposed between the cross members of the frame and the base frame so as to vary the vertical orientation of the frame on the base frame.

* * * * *